US012385347B2

(12) United States Patent
Cheng

(10) Patent No.: US 12,385,347 B2
(45) Date of Patent: Aug. 12, 2025

(54) REINFORCED COMPRESSION PLATE SPLIT FOR SLIP HANGER

(71) Applicant: Baker Hughes Oilfield Operations LLC, Houston, TX (US)

(72) Inventor: Samuel Cheng, Katy, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 60 days.

(21) Appl. No.: 17/855,406

(22) Filed: Jun. 30, 2022

(65) Prior Publication Data

US 2024/0003213 A1 Jan. 4, 2024

(51) Int. Cl.
*E21B 33/04* (2006.01)

(52) U.S. Cl.
CPC ..... *E21B 33/0422* (2013.01); *E21B 2200/01* (2020.05)

(58) Field of Classification Search
CPC ..... E21B 33/0422; E21B 2200/01
USPC ..... 166/88.2
See application file for complete search history.

(56) References Cited

U.S. PATENT DOCUMENTS 2,408,960 A * 10/1946 Stivason ..... F16L 33/28 285/55
2,676,036 A 4/1954 Arrowood
2,689,139 A 9/1954 Jones
4,291,767 A * 9/1981 Hall, Jr. ..... E21B 33/14 166/93.1
4,896,903 A * 1/1990 Shumard ..... F16L 21/04 285/364
5,031,695 A 7/1991 Cain et al.
5,031,696 A 7/1991 Zwiegel
2005/0052026 A1* 3/2005 Hayashi ..... F16L 23/032 285/415
2011/0186284 A1 8/2011 Jekielek
2014/0062025 A1 3/2014 Hoang et al.
2014/0131954 A1 5/2014 Koleilat et al.
2014/0239633 A1* 8/2014 Swingley ..... F16L 23/0286 29/402.09
2021/0238945 A1* 8/2021 Angers, Jr. ..... E21B 33/12

FOREIGN PATENT DOCUMENTS

CN 105937382 11/2018
WO 2013158030 A1 10/2013

OTHER PUBLICATIONS

Hamidreza S Hobeyri et al., Mudline Suspension (MLS), Petroleum Engineering (Drilling) IAU, Apr. 15, 2018, 37 pages.
International Search Report and Written Opinion mailed Oct. 17, 2023 in PCT Application No. PCT/US2023/026221.
"Wellhead and Production Equipment Catalogue, Sentry Wellhead Systems, Jan. 2017, http://sentrywellhead.com/wp-content/uploads/2017/02/Sentry-Wellhead-Catalog.pdf, Excerpt thereof, 14 excerpted pages of 129 pages previously submitted".

* cited by examiner

*Primary Examiner* — Tara Schimpf
*Assistant Examiner* — Patrick F Lambe
(74) *Attorney, Agent, or Firm* — Hogan Lovells US LLP

(57) ABSTRACT

A compression plate to be used with a slip hanger is disclosed in at least one embodiment along with embodiments of methods to prepare and use such a compression plate. The compression plate includes at least one bolt hole and includes at least one split in the at least one bolt hole.

20 Claims, 6 Drawing Sheets

REINFORCED COMPRESSION PLATE SPLIT FOR SLIP HANGER

BACKGROUND

1. Field of Invention

This invention relates in general to slip hangers to be used around casing, and, in particular, to a compression plate that includes at least one bolt hole and includes at least one split in the at least one bolt hole to improve pre-loading of a seal in the slip hanger.

2. Description of the Prior Art

A wellhead may be provided in an oil and gas drilling operation to suspend casings or strings, to seal annulus between such casings and strings, and to provide interfaces for aspects of the wellhead, such as a blow-out preventer ("BOP"). In a drilling operation, concentric casings may be delivered downhole of a well to support a borehole. Such casings can also isolate a borehole from different fluid producing zones. The wellhead may be used to support casing hangers that in turn support a weight of the casings. A slip hanger includes a seal and may be provided to prevent well fluid from escaping through a head of a casing. Furthermore, a force may be necessary to energize a seal of the slip hanger.

SUMMARY

In at least one embodiment, a compression plate to be used with a slip hanger is disclosed. The compression plate includes at least one bolt hole and includes at least one split in the at least one bolt hole.

In at least one embodiment, a method for preparing a compression plate to be used with a slip hanger is disclosed. The method includes machining the compression plate according to predetermined dimensions. A further step in the method includes drilling at least one bolt hole in the compression plate. A splitting is performed for the compression plate to be split at the at least one bolt hole.

In at least one embodiment, a method for a compression plate to be used with a slip hanger is disclosed. The method includes providing the compression plate in multiple sections to be associated together around a casing. The multiple sections join to form at least one split that is within at least one bolt hole of the compression plate. The method includes assembling the compression plate with at least one bolt through the at least one bolt hole.

BRIEF DESCRIPTION OF THE DRAWINGS

Various embodiments in accordance with the present disclosure will be described with reference to the drawings, in which.

DETAILED DESCRIPTION

Figure 1:
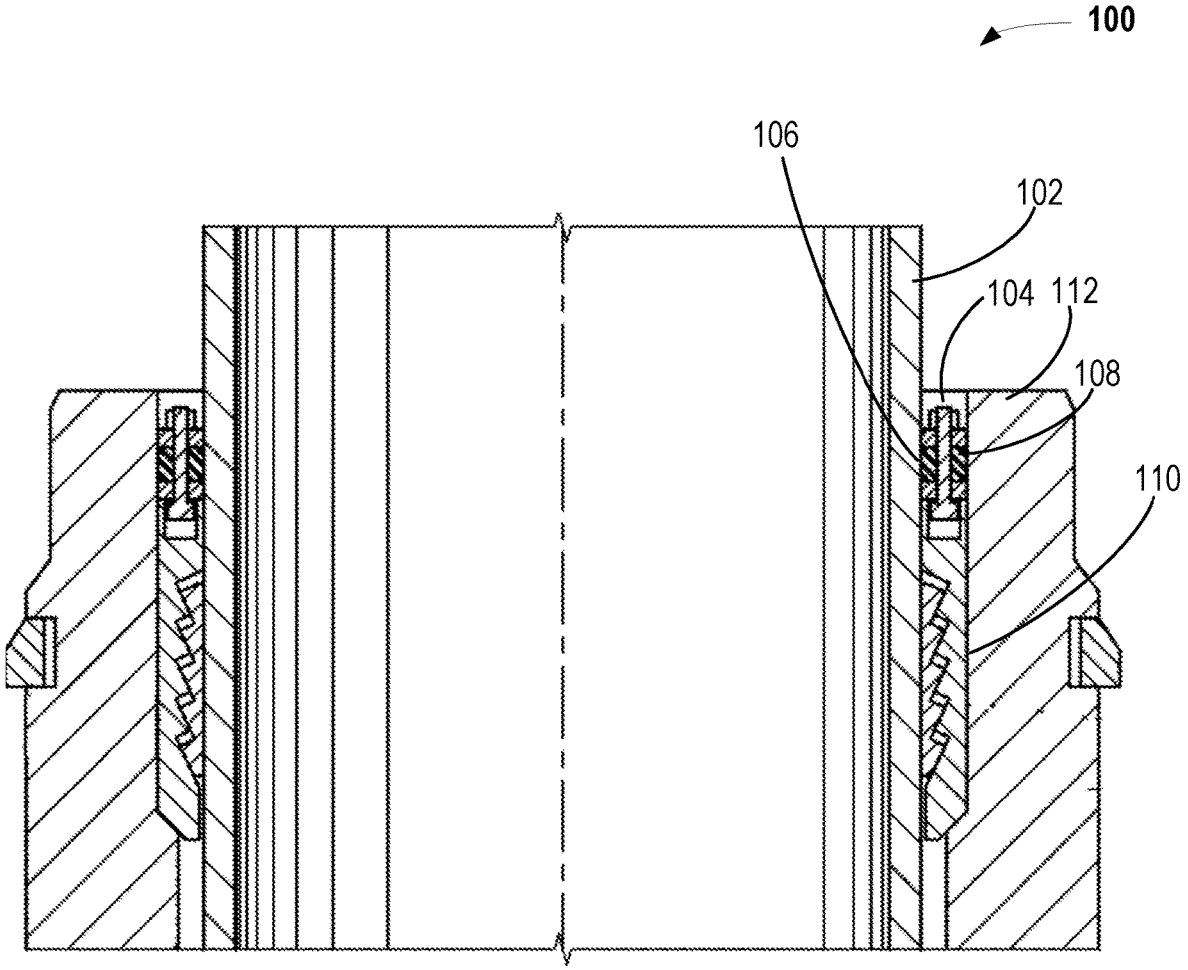
FIG. 1 illustrates a section view of a casing and associated slip hanger, in accordance with at least one embodiment.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Various other functions can be implemented within the various embodiments as well as discussed and suggested elsewhere herein. In at least one embodiment, the present disclosure is to a compression plate to be used with a slip hanger, along with embodiments of methods to prepare and use such a compression plate, where the compression plate includes at least one bolt hole and includes at least one split in the at least one bolt hole.

In at least one embodiment, manually energized slip hangers may be installed around a section of a casing by wrapping the slip hanger around the casing. A seal, such as a compression seal, may be split or cut in sections (such as two halves) and assembled with the compression plate that is over the seal and a slip bowl that is under the seal. The slip bowl may be also in sections with the sections joining at a gland split. This assembly is so that each section (such as a half) of the seal is aligned with a section (such as a half) of a slip bowl in the slip hanger. In at least one embodiment, each of such sections of a seal, of a slip bowl, or of a compression plate when used in conjunction with such features of a slip hanger may be referred to herein as halves with reference to each of such section of such features of a slip hanger, but may be referred to also as triples, quarters, when provided in more sections than the halves.

In at least one embodiment, a seal bridge, which is an area of the seal that is between the halves of the slip bowl may be a weak point of the seal. This may be the case as a split on a top compression plate may be aligned with a seal split of the seal (or may be proximate to the seal split). Then, an end forming the split of the compression plate may be significantly less stiff than solid portions of the compression plate. As a result a compressive force, resulting from bolt preload may not be evenly applied through the compression plate to the seal during energization and operation and this may be evident in the split sections of the compression plate, the seal, and the slip bowl.

In at least one embodiment, offsetting a split of a compression plate so that the split is within at least one bolt hole and overlaps a seal split (at the seal bridge) is described herein. The seal bridge may then come under the direct cones of influence from preloaded bolts, where the cones of influence reflect how a bolt tension clamping force extends on opposite sides of the seal split and the gland split. In at least one embodiment, therefore, the bolts on either side of a split of the compression plate can apply a clamping force subsequent to the bolt preload, through the compression plate, that covers the seal split. For example, the seal can be uniformly compressed across the seal bridge, as a result.

In at least one embodiment, a section of the compression plate having the split in at least one bolt hole can enable such a section to evenly apply a bolt preload to the seal split of the seal, while maintaining a wrap-around functionality. The offsetting of the split of the compression plate to be within a bolt hole and under a bolt head of a bolt applied to the bolt hole enables the cone of influence to apply through the compression plate directly to either side of the compression plate split. The split area that includes the seal split and the gland split is fully supported, as a result. Therefore, a preload that is applied to the bolts can be evenly distributed through the compression plate and around the seal split. Moreover, the split end of the compression plate, that would otherwise be the least stiff section and unsupported if not split in at least one bolt hole, is now fully supported and directly compressed by the a bolt preload. This is advantageous as it allows for a more robust seal to be formed using the slip hanger, without compromising the wrap-around functionality.

In at least one embodiment, the features herein address when the seal split is not offset from a gland split in the slip bowl that is below the seal and from the split of the compression plate that is above the seal. The features herein particularly address a weak point of the seal formed in this manner and that is supported by a weak part of the slip bowl (such as the gland split of the slip bowl). For example, an alignment (or proximate alignment) of the seal split, the gland split, and the split of the compression plate can result in a weak point of the slip hanger and particularly for the compression plate that is a least stiff section of the gland split and the compression plate. Further, a compression plate having a split and that is not fully supported at ends forming the split can behave as a cantilever beam that can deform as the seal is set. Such deformation can result in a lower seal compression load, which can weaken the seal and can result in an ineffective seal at the seal split region. A result from these issues is that a compression seal may not be fully energized along such splits and can lead to leakage of well fluid.

In at least one embodiment, providing a split within a bolt hole of a compression plate that is not proximate to the seal split of the seal is so that both ends of the split of the compression plate enable downward compression on the seal. In at least one embodiment, such a feature does not require in-field disassembly. Further, an advantage realized using features herein is that the slip hanger can be wrapped around the casing in the field without removing or installing any bolts or parts in the field.

Features herein therefore also address requirements to assemble a slip hanger in the field. For example, such requirements may be to remove multiple fasteners, such as cap screws, from the slip hanger and to adjust the seal to overlap the gland split by at least one bolt hole. In at least one embodiment, doing so requires that at least two cap screws of the slip hanger are to be installed in the field, which can increase field time and can increases a risk associated with objects dropping into the well.

FIG. 1 illustrates a section view 100 of a casing 102 and associated slip hanger 104, in accordance with at least one embodiment. The slip hanger 104 may circumscribe an outer surface of a casing 102 and may be positioned between the outer surface 106 of the casing 102 and an inner surface 110 of a casing head 112. The slip hanger 104 may include a compression plate that is bolted to an upper portion of a slip bowl, which further illustrated in FIG. 2. The slip hanger 104 includes a seal 108. In at least one embodiment, the seal 108 may be of an elastomeric material. However, other materials can be readily understood to be used in seals for a slip hanger based at least on the disclosure herein.

Figure 2:
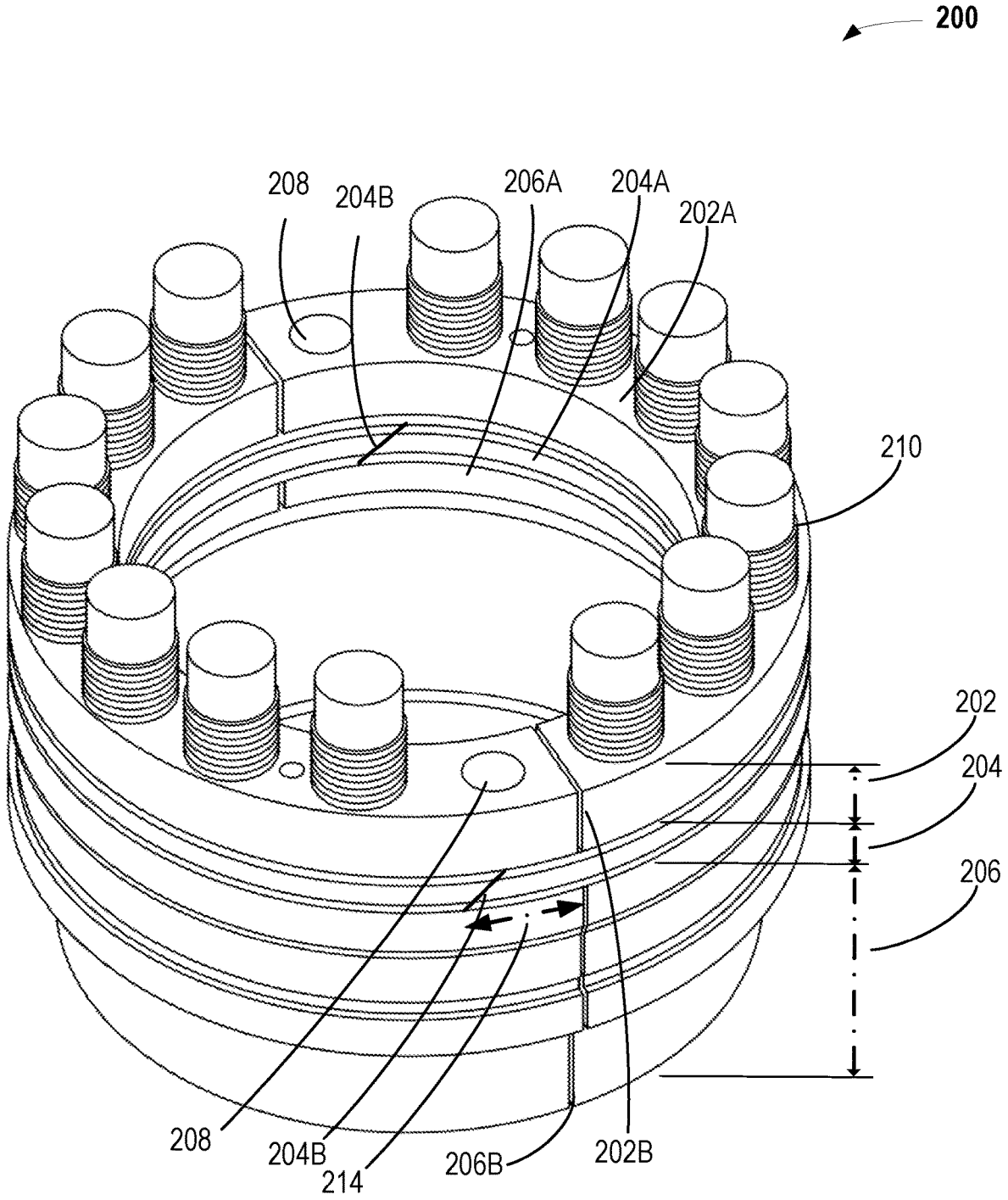
FIG. 2 illustrates a slip hanger, in part, that is subject to improvements of at least one embodiment herein.

FIG. 2 illustrates a slip hanger 200 that may be slip hanger 104 of FIG. 1, in part, that is subject to improvements of at least one embodiment herein. In at least one embodiment, the seal hanger includes a compression plate 202 positioned over the seal 204, which in turn may be positioned over a slip bowl 206. Furthermore, a bottom plate may be positioned adjacent to or may be integral with the slip bowl 206. A number of bolts/or fasteners 210 (also referred to herein as clamping members) may be provided for the bolt holes 208. In at least one embodiment, the bolts 210 may include an elongated body to extend through the bolt holes 208. The bolt holes 208 start from the compression plate 202 and extend through the seal 204, and through at least part of the slip bowl 206.

The bolts 210 may rigidly connect the compression plate 202 to the slip bowl 206. In at least one embodiment, therefore, the lower end of each bolt 210 independently connects to an upper portion of the slip bowl 206. A washer stack and/or additional connectors may be provided individually or collectively, with the bolt 210. The bolt 210 enables the compression plate 202 to apply a compression force on the seal 204 to put the seal 204 in a compressed state.

In at least one embodiment, manually energized slip hangers, such as illustrated in FIG. 2, may be installed around a section of a casing by wrapping the slip hanger 200 around the casing such as by wrapping individual sections 202A, 204A, 206A, which are marked as one halves of the compression plate 202, the seal 204, and the slip bowl 206, around a casing 102 (with their other halves that are not marked) before applying the bolts 210.

In at least one embodiment, therefore, the seal 204 may be split or cut in sections 204A (such as two halves) and assembled with sections 202A of the compression plate 202 that is over the seal 204 and with sections 206A of the slip bowl 206 that is under the seal 204. The slip bowl 206 that is in sections 206A have the sections 206A joining at a gland split 206B. This assembly is so that each half 204A of the seal 204 is aligned with a section (such as a half) 206A of a slip bowl 206 in the slip hanger 200.

In at least one embodiment, a seal bridge 214 occurs in an area of the seal that is between the halves 206A of the slip bowl 206. The seal bridge 214 may be a weak point of the seal and subsequently of the slip hanger 200. This may be the case as a split 202B on a top compression plate 202 may be aligned with a seal split 204B of the seal 204 (or may be proximate to the seal split). Then, an end forming the split 202B of the compression plate 202 may be significantly less stiff than solid portions of the compression plate 202. As a result, a bolt preload may not be evenly applied through the compression plate 202 when a compressive force applied to the seal 204 by the bolts 210 and this is evident in the split sections 202A, 204A, 206A of the compression plate 202, the seal 204, and the slip bowl 206.

In at least one embodiment, the features herein address when the seal split 204B that is not offset from a gland split 206B and split 202B of a compression plate, and instead, may be coincidental with the gland split 206B of the slip bowl 206 and the split 202B of the compression plate 202. The features herein particularly address a weak point of the seal formed in this manner and that is supported by a weak part of the slip hanger components (such as the gland split 206B of the slip bowl 206 and the split 202B of the compression plate 202). For example, an alignment (or proximate alignment) of the seal split 204B, the gland split 206B, and the split 202B of the compression plate 202 then results in a weak point of the slip hanger 200 that is a least stiff section of the gland split 206B and the split 202B of the compression plate 202. A result from these issues is that a compression seal 202 may not be fully energized along such splits 202B, 204B, 206B and can lead to leakage of well fluid.

Figure 3:
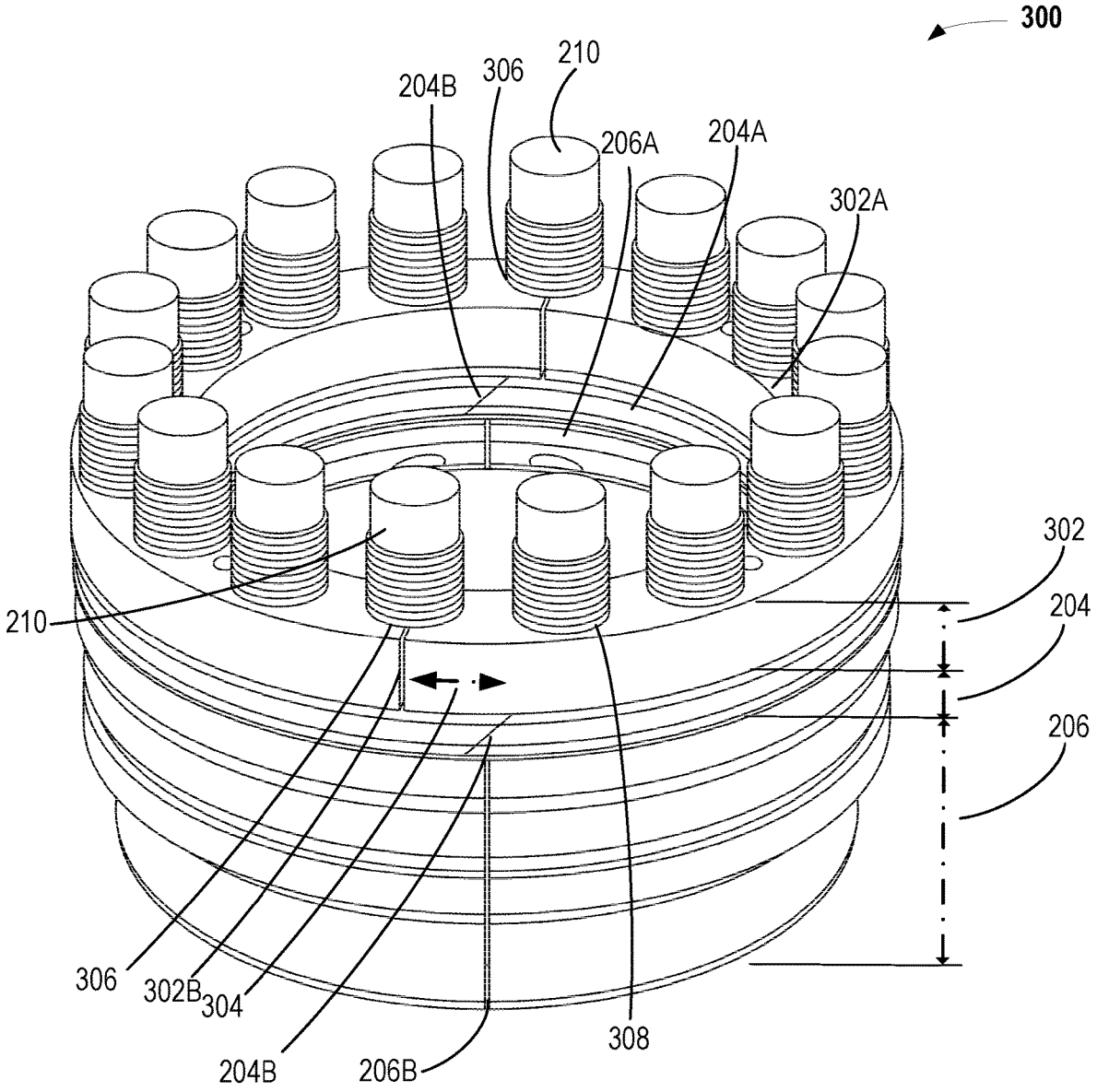
FIG. 3 illustrates a slip hanger of at least one embodiment.
Figure 4:
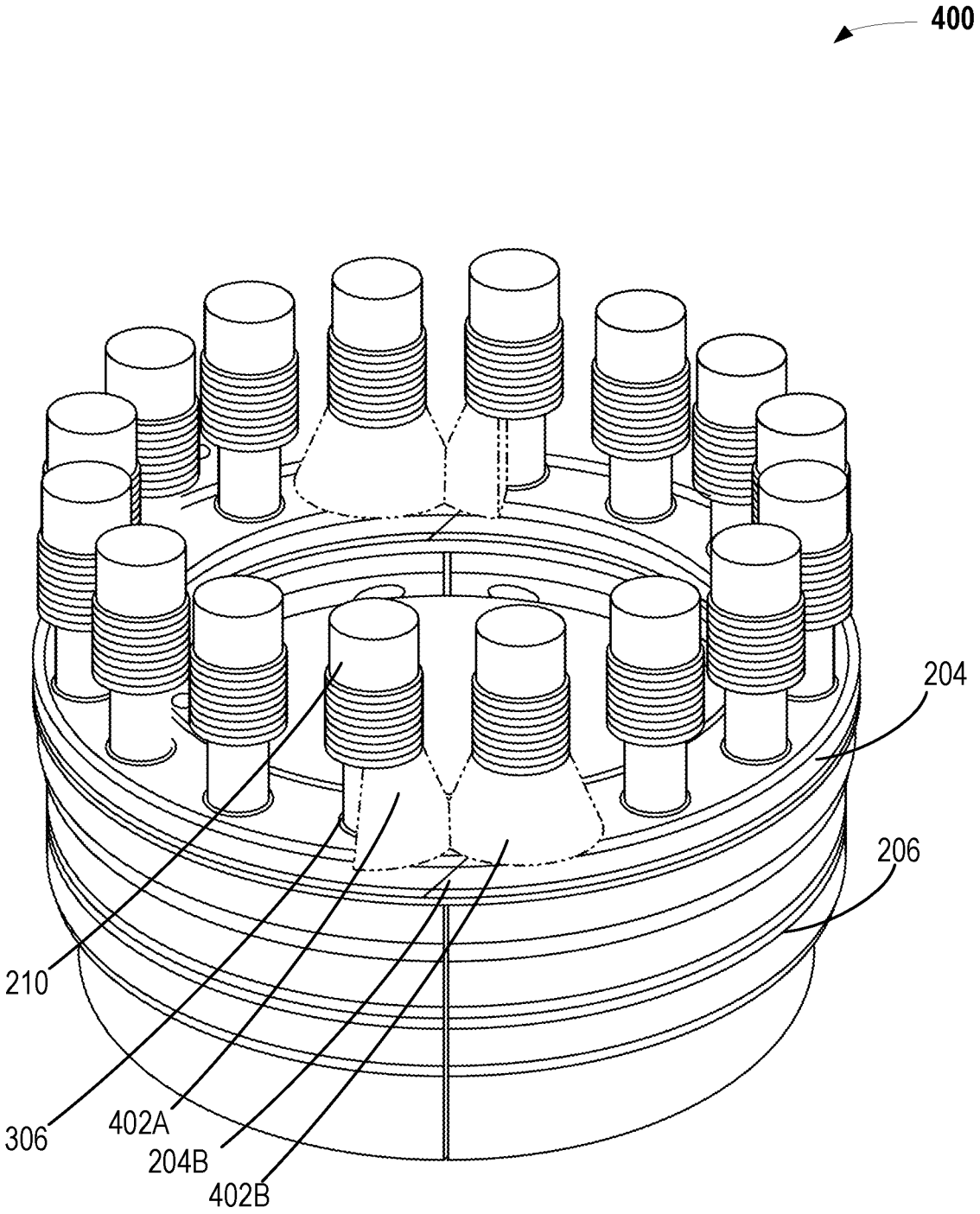
FIG. 4 illustrates cones of bolt influence during preloading of a slip hanger according to at least one embodiment.

FIG. 3 illustrates a slip hanger 300 of at least one embodiment. In at least one embodiment, relative to FIG. 2, a split 302B of a compression plate 302 is so that the split 302B is within at least one bolt hole 306. Further, the split 302B of the compression plate 302 overlaps a seal split 204B (such as at or proximate to the seal bridge previously described) of a seal 204. The seal bridge described herein may then come under a cone of influence from a preloaded bolt 210. FIG. 4 illustrates cones 402A, B of influence from a preloaded bolt 210 during energization of a slip hanger according to at least one embodiment. FIG. 4 omits the compression plate 302 through which the cones 402A, B act on the seal 204 and the slip bowl 206, only to illustrate the cones 402A, B of influence overlapping the seal split 204B and a gland split 206B.

Further, the cones 402A, B of influence diagrammatically illustrate how a bolt preload extends on opposite sides of the seal split 204B and the gland split 206B. In at least one embodiment, therefore, the bolts 210 on either side of a split 302B of the compression plate 302 can apply a clamping force subsequent to the bolt preload, through the compression plate 302, that covers the seal split 204B. For example, the seal 204 can be uniformly compressed across the seal bridge, as a result.

In at least one embodiment, a section 302A of the compression plate 302 having the split 302B in at least one bolt hole 306 enables each section 302A to evenly apply a bolt preload to the seal split of the seal 204, while maintaining a wrap-around functionality. An offsetting 304 of the split 302B of the compression plate 302 to be within a bolt hole 306 and under a head of a bolt 210 applied to the bolt hole 306 enables the cone 402A,B of influence to apply through the compression plate 302. The split area that includes the seal split 204B and the gland split 206B is fully supported, as a result. Therefore, a preload that is applied to the bolts 210 can be evenly distributed through the compression plate 302 and around the seal split 204B, relative to FIG. 2. This is advantageous as it allows for a more robust seal to be formed using the slip hanger 300, without compromising the wrap-around functionality or the removal and/or installation of cap screws in the field.

In at least one embodiment, therefore, disclosed herein is a compression plate 302 to be used with a slip hanger 300. The compression plate 302 includes at least one bolt hole 306 and includes at least one split 302B in the at least one bolt hole 306. In at least one embodiment, further, the compression plate 302 includes the split 302B being tangential to the at least one bolt hole 306. In at least one embodiment, if the compression plate is split into two halves, the ends of each half can include part of a bolt hole to be assembled together with the seal and the slip bowl.

In at least one embodiment, a compression plate 302 can therefore include a number of sections, one of which is marked 302A, and not just two halves. The sections of the compression plate are located over a seal 204. The seal 204 includes a number of sections, one which is marked 204A, to be located over a slip bowl 206. In at least one embodiment, the number of sections of a compression plate 302 may be determined based in part on the number of sections of a seal 204. Further, the slip bowl 206 may also include sections, one of which is marked 206A. The compression plate 302, the seal 204, and the slip bowl 206 are to be assembled together around a casing 102.

The compression plate 302 herein includes at least one bolt hole 306 that is adapted to receive at least one bolt 210. The at least one bolt 210 is adapted to receive a force, such as a preloading force. The compression plate 302 is adapted to compress at individual sections, such as a section 302A illustrated, of the compression plate, to compress, energize, and reinforce a seal 204 that is underlying the compression plate 302 by at least the split 302B of the compression plate 302. Therefore, the compression plate 302 is a reinforced compression plate with a split 302B for a slip hanger. In at least one embodiment, a compression plate 302 is adapted to assert uniform downward clamping pressure, at least represented in part via the cones 402A, B of influence, through the individual sections, such as a section 302A, of the compression plate 302.

In at least one embodiment, a compression plate 302 herein supports a seal 204 that is associated with the compression plate 302, where the seal 204 includes a seal split 204B that is between two bolt holes 306, 308 and that include the at least one bolt hole 306 having the split 302B of the compression plate. In at least one embodiment, a compression plate 302 herein includes a number of sections, one section 302A is illustrated, where individual ends of such individual sections can be assembled together to form the at least one split 302B.

In at least one embodiment, a compression plate 302 herein includes individual ones of a number of sections, of which one section 302A is referenced in each of the FIGS. 3 and 4. The number of sections can include part of the at least one bolt hole 306 in at least one of its respective ends, such as an end forming the split 302B of the compression plate 302. In at least one embodiment, a compression plate 302 herein is so that individual ones of the number of sections of the compression plate 302 can be assembled together over a seal 204 to include at least one split 302B in an offset 304 position relative to a seal split 204B of the seal 204.

Figure 5:
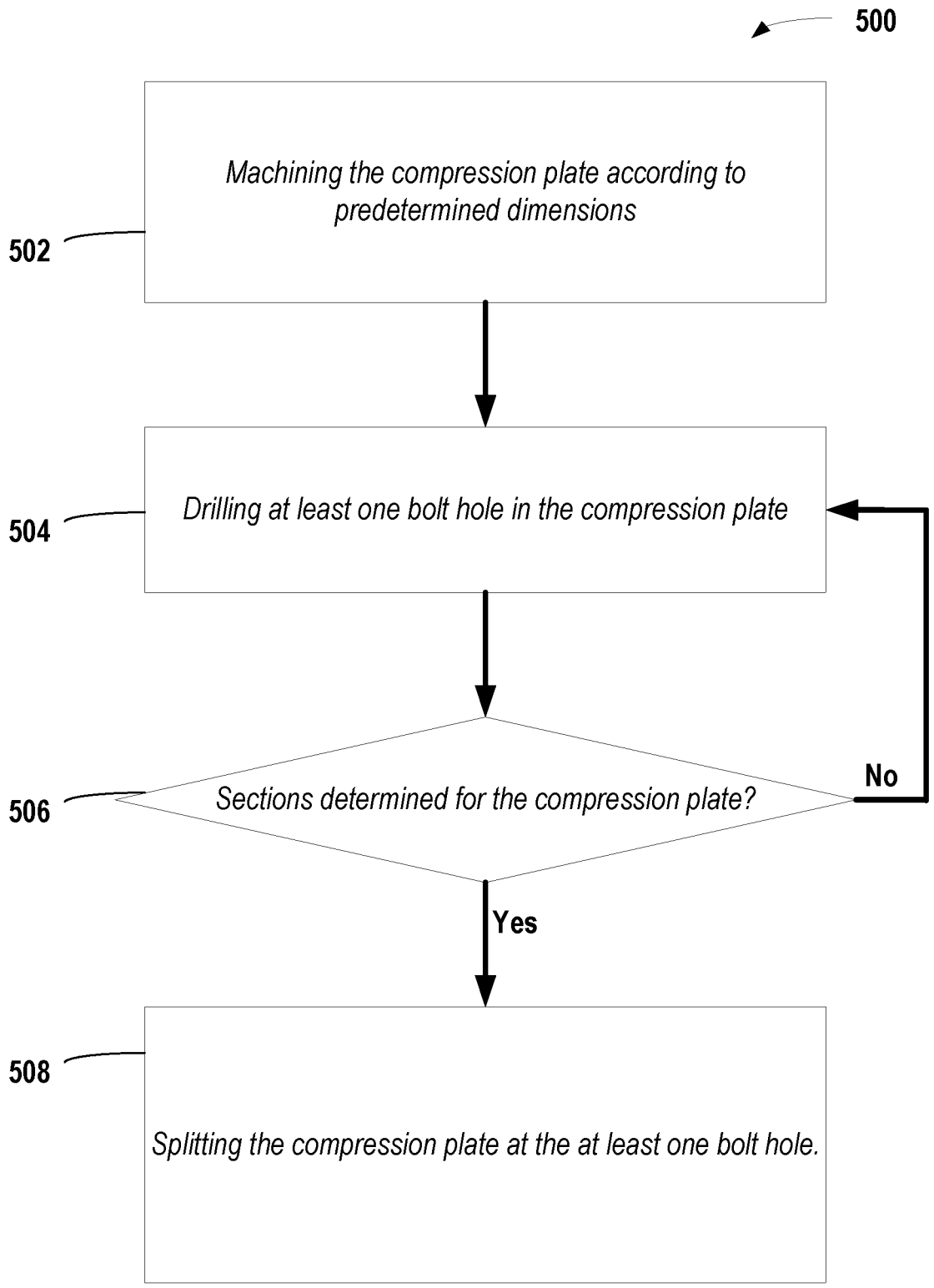
FIG. 5 illustrates a method to be used with the slip hanger in FIGS. 1-4, in accordance with at least one embodiment.

FIG. 5 illustrates a method 500 to be used with the slip hanger in FIGS. 1-4, in accordance with at least one embodiment. In at least one embodiment, the method 500 is for preparing a compression plate 302 to be used with a slip hanger 300. The method 500 includes machining (502) the compression plate according to predetermined dimensions. The method 500 includes drilling (504) at least one bolt hole in the compression plate. In at least one embodiment, the method 500 includes determining (506) a number of sections for the compression plate, such as based in part on a number of section of a seal to be used with the compression plate. The method 500 includes splitting (508) the compression plate at the at least one bolt hole to provide the sections. Further holes in the compression plate may be provided by step 504 herein.

In at least one embodiment, the method 500 herein may include a step or a sub-step for splitting of the compression plate by providing a split, in the at least one bolt hole, that is tangential to the at least one bolt hole, as described at least with respect to FIG. 3. In at least one embodiment, the method 500 herein may include a step or a sub-step for splitting of the compression plate to provide a number of sections for the compression plate to be associated together around a casing of the at least one bolt hole. In at least one embodiment, the method 500 herein may include a step or a sub-step for threading the at least one bolt hole in a body of the slip hanger to enable the at least one bolt hole to receive at least one bolt. The at least one bolt may be adapted to receive a force and the compression plate may be adapted to compress individual sections of the compression plate to energize, compress, and reinforce a seal underlying the compression plate.

Figure 6:
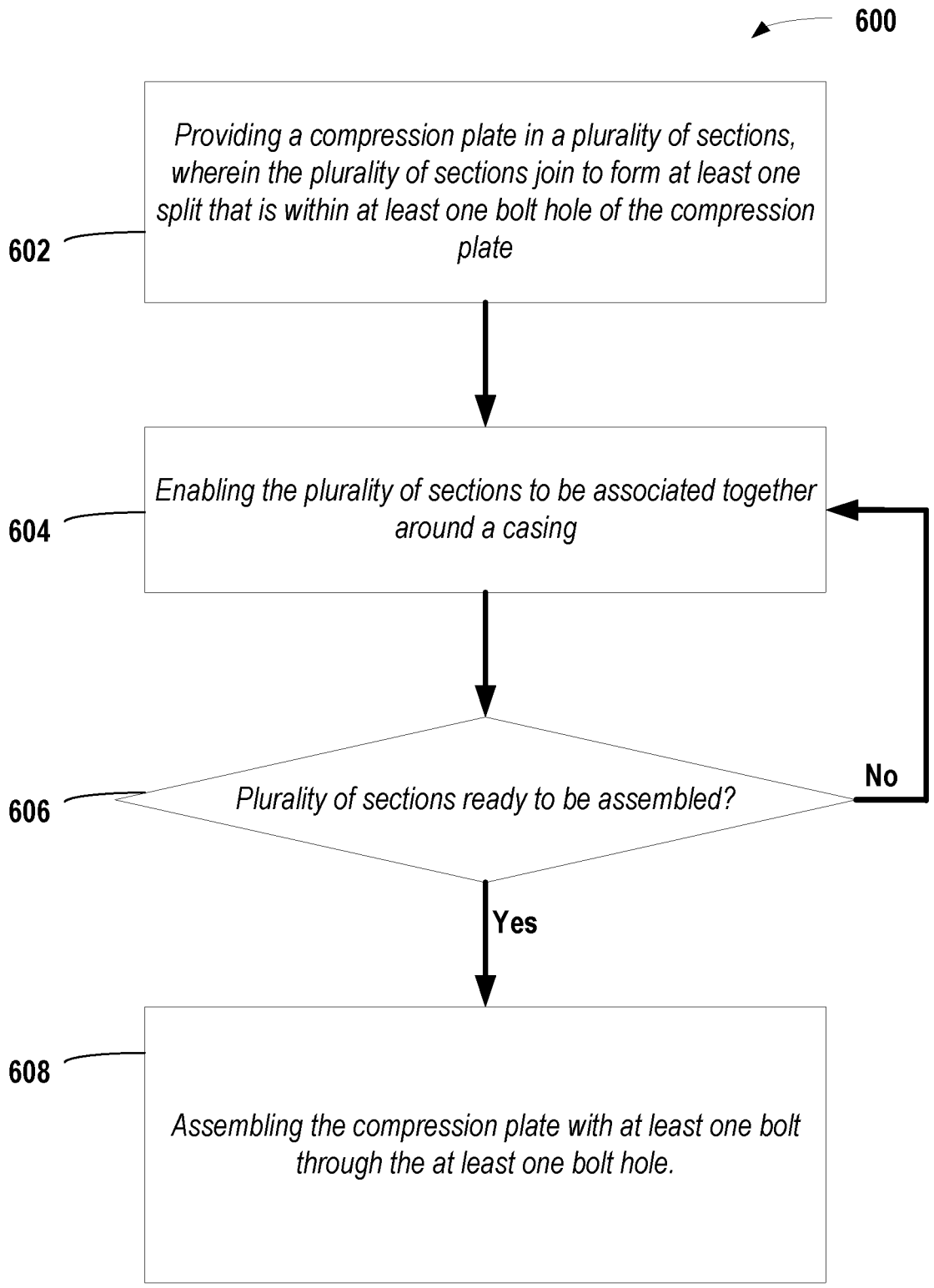
FIG. 6 illustrates another method to be used with the slip hanger in FIGS. 1-4, in accordance with at least one embodiment.

FIG. 6 illustrates another method 600 to be used with the slip hanger in FIGS. 1-4, in accordance with at least one embodiment. In at least one embodiment, the method 600 herein is for a compression plate 302 to be used with a slip hanger 300. The method 600 includes providing (602) the compression plate in a number of sections to be associated together around a casing. The number of sections join to form at least one split that is within at least one bolt hole of the compression plate. The method 600 includes enabling (604) the sections from step 602 to be associated together around a casing. The method 600 includes verifying (606) that the sections are ready to be assembled. This step may include verifying the alignment of the underlying seal and slip bowl. The method 600 includes assembling (608) the compression plate with at least one bolt through the at least one bolt hole.

In at least one embodiment, the method 600 herein may include a step or a sub-step for providing a seal over a lip of a slip bowl. In at least one embodiment, the method 600 herein may include a step or a sub-step for adjusting the seal so that a seal split is offset or coincidental over a gland split. Further, the method 600 herein may include a step or a sub-step for providing the compression plate over the seal. The at least one split is offset relative to the seal split.

In at least one embodiment, the method 600 herein may be performed so that the at least one split is tangential to the at least one bolt hole. In at least one embodiment, the method 600 herein may include a step or a sub-step for providing a preload to the at least one bolt to cause the compression plate to compress individual ones of the plurality of sections of the compression plate to energize, compress, and reinforce a seal underlying the compression plate. In at least one embodiment, the method 600 herein may be performed so that the compression plate is adapted to assert uniform downward clamping pressure through the plurality of sections of the compression plate. In at least one embodiment, the method 600 herein may be performed so that a seal is associated with the compression plate and the seal includes a seal split that is between two bolt holes that include the at least one bolt hole. In at least one embodiment, the method 600 herein may be performed so that individual ends of individual ones of the number of sections form the at least one split and include at least part of the at least one bolt hole.

The specification and drawings are, accordingly, to be regarded in an illustrative rather than a restrictive sense. It will, however, be evident that various modifications and changes may be made thereunto without departing from the broader spirit and scope of the invention as set forth in the claims. Further, any of the many embodiments disclosed here may be combined by a person of ordinary skill using the present disclosure to understand the effects of such combinations.

What is claimed is:

1. A compression plate associated with a seal and a slip bowl of a slip hanger, the compression plate comprising at least one bolt hole and comprising at least one split in the at least one bolt hole, wherein the compression plate is arranged with the at least one split in an offset position relative to a seal split of the seal and with the seal and the slip bowl being under the compression plate, and wherein the seal split is coincidental with a gland split of the slip bowl.

2. The compression plate associated with the seal and the slip bowl of the slip hanger of claim 1, wherein the at least one split being through the at least one bolt hole to provide two halves for the compression plate.

3. The compression plate associated with the seal and the slip bowl of the slip hanger of claim 1, wherein the compression plate comprises a plurality of first sections to be located over the seal, wherein the seal comprises a plurality of second sections to be located over the slip bowl, wherein the slip bowl comprises a plurality of third sections, and wherein the compression plate, the seal, and the slip bowl are to be assembled together around a casing.

4. The compression plate associated with the seal and the slip bowl of the slip hanger of claim 1, wherein the at least one bolt hole is adapted to receive at least one bolt, wherein the at least one bolt is adapted to receive a force and wherein the compression plate is adapted to compress at individual sections of the compression plate and is adapted to compress the seal underlying the compression plate.

5. The compression plate associated with the seal and the slip bowl of the slip hanger of claim 4, wherein the compression plate is adapted to assert uniform downward clamping pressure through the individual sections of the compression plate.

6. The compression plate associated with the seal and the slip bowl of the slip hanger of claim 1, wherein the at least one bolt hole that is between two further bolt holes, individual ones of the two further bolt holes being on either side of the at least one bolt hole.

7. The compression plate associated with the seal and the slip bowl of the slip hanger of claim 1, further comprising:

a plurality of sections, wherein individual ends of individual ones of the plurality of sections assembled together form the at least one split.

8. The compression plate associated with the seal and the slip bowl of the slip hanger of claim 7, wherein individual ends of individual ones of the plurality of sections comprise at least part of the at least one bolt hole.

9. The compression plate associated with the seal and the slip bowl of the slip hanger of claim 7, wherein individual ones of the plurality of sections of the compression plate are assembled together over the seal, and wherein the at least one split of the bolt hole is in the offset position relative to the seal split of the seal.

10. A method for preparing a compression plate used with a seal and a slip bowl of a slip hanger, the method comprising:

machining the compression plate according to predetermined dimensions; and drilling at least one bolt hole in the compression plate; and splitting the compression plate at the at least one bolt hole, wherein the splitting provides at least one split in the at least one bolt hole, the at least one split being predetermined to enable arrangement of the compression plate with the at least one split in an offset position relative to a seal split of the seal and with the seal and the slip bowl being under the compression plate, and wherein the seal split is coincidental with a gland split of the slip bowl.

11. The method of claim 10, wherein the splitting of the compression plate further comprises:

providing the at least one split through the at least one bolt hole to provide two halves for the compression plate.

12. The method claim 10, wherein the splitting of the compression plate provides a plurality of sections for the compression plate to be associated together around a casing.

13. The method of claim 10, further comprising:

threading the at least one bolt hole of a body of the slip hanger to enable the at least one bolt hole to receive at least one bolt, wherein the at least one bolt is adapted to receive a force and wherein the compression plate is adapted to compress individual sections of the compression plate to compress the seal underlying the compression plate.

14. A method for a compression plate used with a seal and with a slip bowl of a slip hanger, the method comprising:

providing the compression plate in a plurality of sections and associated together around a casing, wherein the plurality of sections join to form at least one split that is within at least one bolt hole of the compression plate;

arranging the at least one split of the compression plate in an offset position relative to a seal split of the seal, wherein the seal split is coincidental with a gland split of the slip bowl and assembling the compression plate with at least one bolt through the at least one bolt hole.

15. The method of claim 14, further comprising:

providing the seal over a lip of the slip bowl; and providing the plurality of sections of the compression plate over the seal and over the slip bowl.

16. The method claim 14, wherein the at least one split is through the at least one bolt hole to provide two halves for the compression plate, the two halves of the compression plate forming the plurality of sections.

17. The method of claim 14, further comprising:

providing a preload to the at least one bolt to cause the compression plate to compress individual ones of the plurality of sections of the compression plate and to compress the seal underlying the compression plate.

18. The method of claim 14, wherein the compression plate is adapted to assert uniform downward clamping pressure through the plurality of sections of the compression plate.

19. The method of claim 14, wherein the at least one bolt hole that is between two further bolt holes, individual ones of the two further bolt holes being on either side of the at least one bolt hole.

20. The method of claim 14, wherein individual ends of individual ones of the plurality of sections comprise at least part of the at least one bolt hole.

* * * * *